United States Patent [19]

Ramirez et al.

[11] Patent Number: 4,872,389

[45] Date of Patent: Oct. 10, 1989

[54] DETACHABLE MOUTHPIPE ASSEMBLY

[75] Inventors: Lawrence Ramirez, Elkhorn; Walter Whiteside, Kenosha, both of Wis.

[73] Assignee: G. LeBlanc Corporation, Kenosha, Wis.

[21] Appl. No.: 294,871

[22] Filed: Jan. 9, 1989

[51] Int. Cl.[4] ..... G10D 7/10

[52] U.S. Cl. ..... 84/387 R; 84/393

[58] Field of Search ..... 84/387–390, 84/393–394, 398–399

[56] References Cited

U.S. PATENT DOCUMENTS 629,254 7/1899 Horn et al. ..... 84/394

2,484,408 10/1949 Hubley ..... 84/390

FOREIGN PATENT DOCUMENTS 14320 of 1911 United Kingdom ..... 84/389

*Primary Examiner*—Lawrence R. Franklin

*Attorney, Agent, or Firm*—Richard Bushnell

[57] ABSTRACT

A detachable mouthpipe assembly for releasably attaching a mouthpipe having a reduced end portion to a musical instrument having a receiving aperture for receiving the reduced end portion. The detachable mouthpipe assembly includes a substantially U-shaped saddle member attached to the musical instrument and a swivel screw pivotally attached to the saddle member. A slotted arm member is attached to the mouthpipe end engagable with the swivel screw and saddle member.

9 Claims, 2 Drawing Sheets

DETACHABLE MOUTHPIPE ASSEMBLY

BACKGROUND OF THE INVENTION

The present invention relates to a brass wind musical instrument and more specifically to a novel detachable mouthpipe assembly having a clamping device that enables a mouthpipe to be quickly and easily attached and removed from a musical instrument.

In the past, most brass wind musical instruments, such as a french horn, have had a fixed mouthpipe soldered in place. Importantly, different mouthpipes are capable of producing different sounds. For example, some mouthpipes have a certain prescribed taper design for a more focused, centered sound that is ideal for solo playing, chamber music or high note work. Other mouthpipes having a different taper might produce a different sound and/or "sphere" that would be more ideal for a "bigger" sound or a more open feel.

Thus, in some instances it is desirable to have a detachable mouthpipe assembly so that different mouthpipes which produce different sounds can be attached to the instrument. There are some prior art french horns that have detachable mouthpipes. Generally, these detachable mouthpipes are held in place by set-screws or lock nuts. Consequently, tools are required to remove the mouthpipe. This procedure can take several minutes.

In certain situations, such as a concert or the like, it may be necessary or desirable for a musician to be able to change the mouthpipe during the course of a particular piece of music. Thus, it would be necessary to be able to remove the mouthpipe and attach a new mouthpipe in a matter of seconds.

Accordingly, a general object of the present invention is to provide a detachable mouthpipe assembly that can be removed and attached to the instrument easily and quickly without the aid of any tools or the like.

A more specific object of the present invention is to provide a detachable mouthpipe assembly that includes a clamping device having a slotted arm member engagable with a swivel screw and saddle.

SUMMARY OF THE INVENTION

A detachable mouthpipe assembly for releasably attaching a mouthpipe having a reduced end portion to a musical instrument having a receiving aperture for releasably receiving the reduced end portion. The detachable mouthpipe assembly includes a substantially U-shaped saddle member connected to a predetermined portion of the musical instrument and a swivel screw pivotally attached to the saddle member having a head portion and a shaft extending substantially vertically therefrom. The swivel screw swivels between a first and second position. A slotted arm member is attached to a predetermined portion of the mouthpipe and engagable with the swivel screw and saddle member and a knob releasably engaging the shaft of the swivel screw securing the mouthpipe to the musical instrument.

BRIEF DESCRIPTION OF THE DRAWINGS

Features of the present invention which are believed to be novel are set forth with particularity in the appended claims. The organization and manner of operation of the invention, together with further objects and advantages thereof, may best be understood by reference to the following description taken in connection with the accompanying drawings in which:

DETAILED DESCRIPTION OF THE ILLUSTRATED EMBODIMENT

Figure 1:
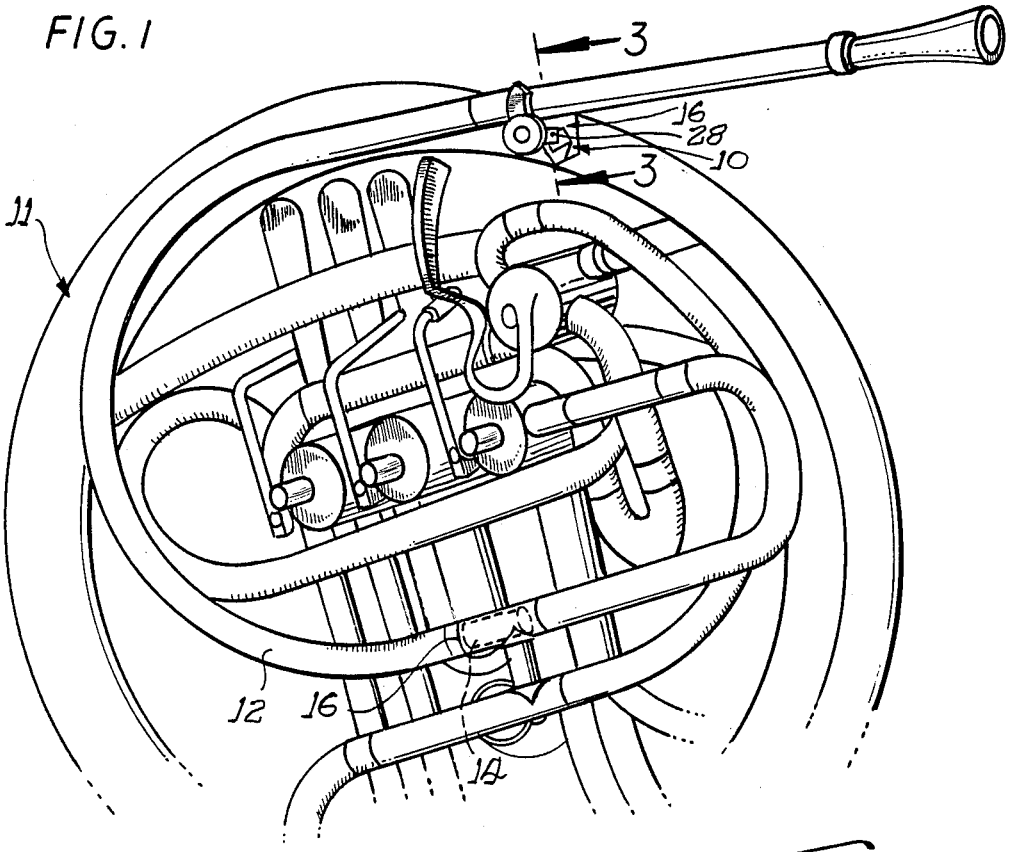
FIG. 1 is an elevational side view showing the detachable mouthpipe assembly incorporating the features of the present invention.

Turning to the drawings, wherein like components are designated by like reference numerals throughout the various figures, a detachable mouthpipe assembly, constructed in accordance with the present invention is illustrated in FIGS. 1-8, and generally designated by reference numeral 10.

Figure 2:
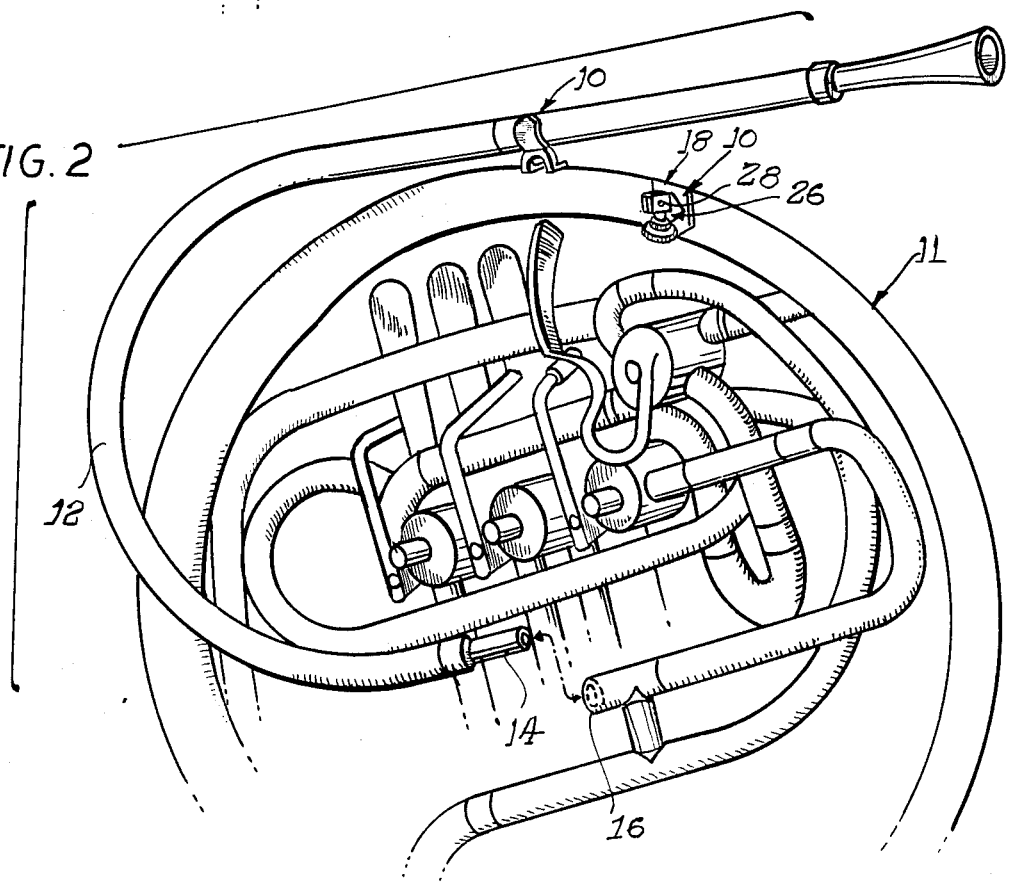
FIG. 2 is an elevational side view showing the detachable mouthpipe assembly in an unassembled condition.

As shown best in FIGS. 1 and 2, the detachable mouthpipe assembly or clamping device 10 secures a mouthpipe 12 to an instrument such as a french horn 11.

The detachable mouthpipe 12 includes a reduced portion 14 at one end thereof. The instrument 11 includes a receiving aperture 16 for releasably receiving the reduced portion 14.

As shown in FIGS. 1 and 2, the outer circumference of the reduced portion 14 is slightly less than the inner circumference of the receiving aperture 16. Thus, the reduced portion 14 can be securely held in place in the receiving aperture 16.

The mouthpipe assembly 10 includes a saddle member 18 which is welded to a predetermined portion of the french horn 11 as shown best in FIGS. 1 and 2. The saddle 18 is substantially U-shaped and includes an end wall or base portion 20 connected to a pair of laterally spaced end walls 22 and 24.

Figure 3:
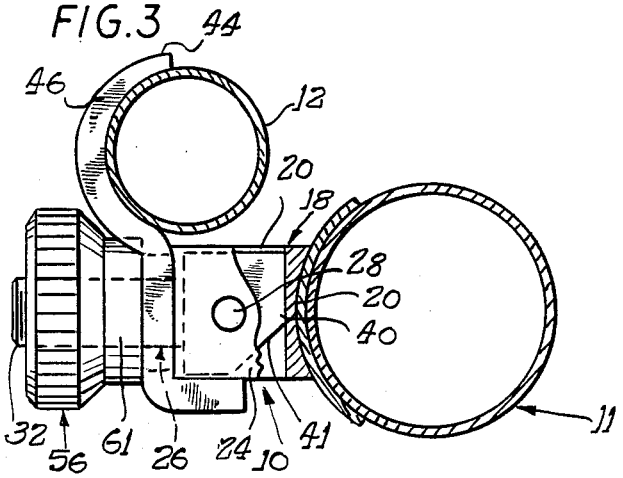
FIG. 3 is an enlarged sectional view taken along line 3—3 of FIG. 1.
Figure 4:
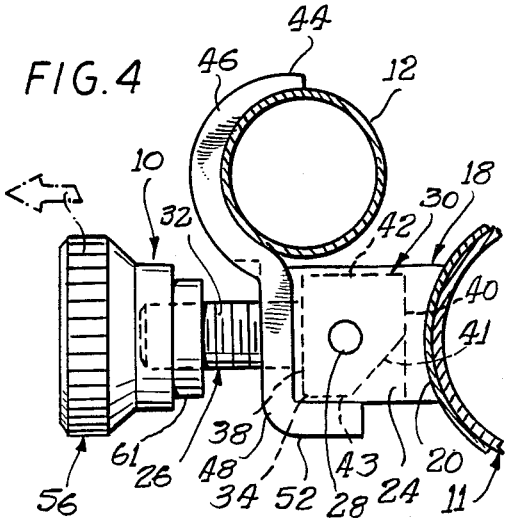
FIG. 4 is an enlarged fragmentary sectional view similar to FIG. 3, but showing the knob of the mouthpipe assembly in a pulled out position.

The bottom of the base portion 20 is concave and fits flush against the curved radius of a portion of the french horn 11 as shown in FIGS. 3 and 4.

A swivel screw 26 is pivotally attached to saddle 18 by pivot pin 28. The swivel screw 26 includes a head portion 30 having a shaft 32 extending substantially vertically therefrom. Shaft 32 includes a plurality of threads 33.

The head 30 is pivotally secured between side walls 22 and 24 of the saddle member 18 by pivot pin 28. As shown best in FIGS. 4 and 5, the head portion 30 includes two parallel side walls 34 and 36 laterally spaced from each other and connected to two parallel end walls 38 and 40 and a top wall 42 and a bottom wall 43. A corner of the head portion 30 is beveled at 41 so that the wall 40 is approximately one-half the length of wall 38. In addition, the length of the bottom wall 43 is approximately one-half the length of the top wall 42.

Figure 5:
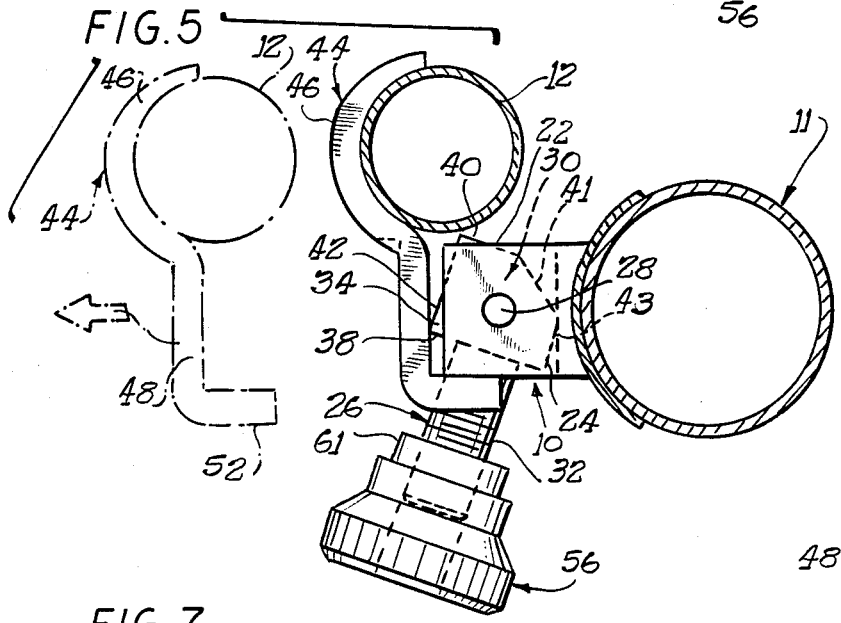
FIG. 5 is a sectional view of the mouthpipe assembly in a partially assembled condition.
Figure 6:
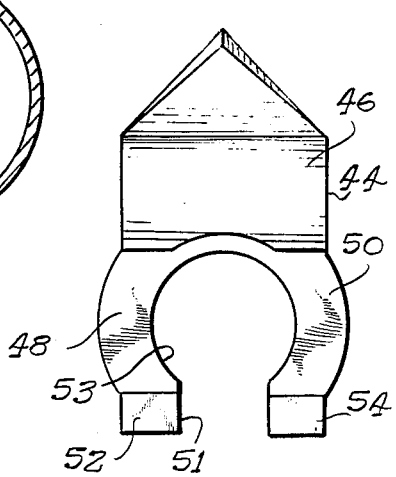
FIG. 6 is a side elevational view of the slotted arm of the mouthpipe assembly.

Thus, constructed the swivel screw 26 can move or swivel between a substantially horizontal first position as shown in FIG. 4 to a second position in which the shaft 32 of the swivel screw 26 is inclined downwardly as shown in FIG. 5.

The detachable mouthpipe assembly 10 also includes a slotted arm member 44. As shown in FIGS. 1-5, the slotted arm 44 includes a curved portion or end 46 having a gradually tapering end. The curved portion 46 is adapted to lay flush against a portion of the mouthpipe 12 as shown best in FIGS. 3-5. A pair of laterally spaced arm members 48 and 50 extends substantially vertically from each side of the free end of curved portion 46. The legs 48 and 50 gradually curve outwardly or away from each other and then curve back towards each other to define a slot 51 (see FIG. 6) so that the shaft 32 of swivel screw 26 can pass therethrough when the swivel screw 26 is moved to the horizontal position. The space between the curved sections of legs 48 and 50 is substantially circular and defines a circular seat 53 for the purpose described below.

The slotted arm member 44 includes bent members 52 and 54 which extend substantially laterally from the free end of each arm 48 and 50 respectively. The bent members 52 and 54 are engagable with side portions 22 and 24 of the saddle 18.

The mouthpipe assembly 10 also includes a knob 56. The knob 56 includes a hollow cylindrical portion 57 for receiving the cylindrical shaft 32. The hollow cylindrical portion 57 is provided with a base 59 having internal threads 60 engagable with the threads 33 on shaft 32. Thus, knob 56 can be screwed onto the shaft 32 of the swivel screw 26. The outer diameter of the knob 56 is greater than the distance between arms 48 and 50 of the slotted arm 44. The knob 56 has a reduced diameter end portion 61 adapted to fit snugly in the seat 53 for locking the slotted arm 44 and thus the mouthpipe with respect to the screw.

In order to attach the mouthpipe 12 to the musical instrument 11, the swivel screw 26 is pushed into the downward or second position. Then, the reduced portion 14 of the mouthpipe is manually inserted into the receiving aperture 16 of the musical instrument 11 as shown in FIGS. 1 and 2.

Thus assembled, the slotted arm 44, which is attached to a portion of the mouthpipe 12, is in a position adjacent to the swivel screw 26 and saddle 18 which is attached to a portion of the musical instrument 11. The slotted arm 44 is then brought into contact with the bottom of saddle 18 so that the bent portions 52 and 54 engage the side walls 24 and 22 of the saddle member 18 and interlock the parts.

Figure 7:
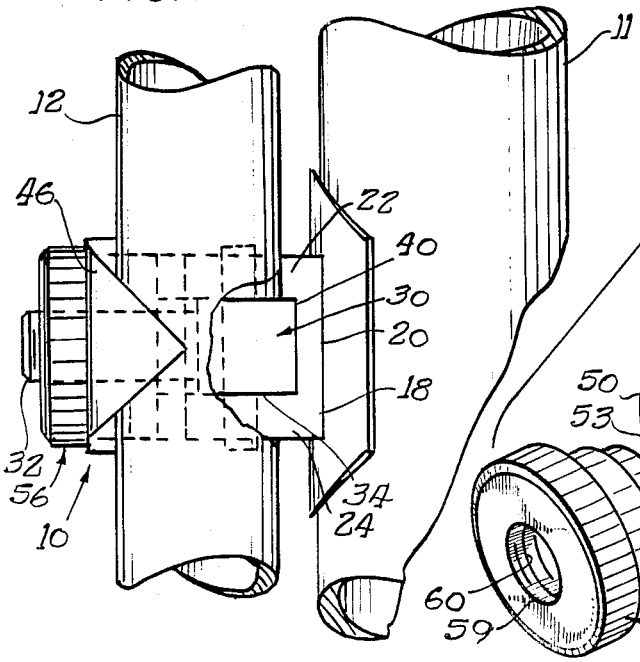
FIG. 7 is a top plan view of FIG. 3.
Figure 8:
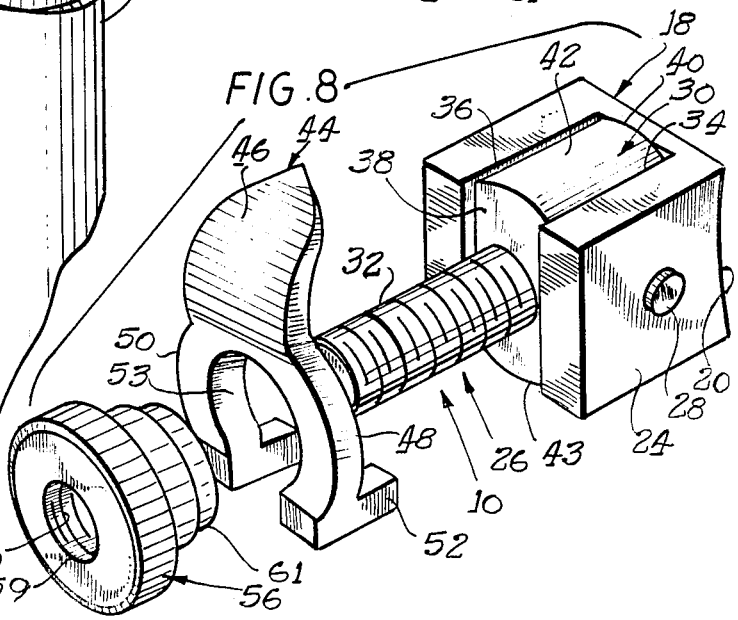
FIG. 8 is an exploded view of the mouthpipe assembly clamping means.

The swivel arm 26 is then moved or swiveled into the horizontal or first position as shown in FIGS. 3, 4 and 7 so that shaft 32 extends through the space between arms 48 and 50 of the slotted arm 40. The knob 56 is tightly screwed onto the end of shaft 32 of the swivel screw 26 until the end portion 61 fits snugly in the seat 53. As shown in FIG. 3, when the knob 56 is fully threaded onto the end of the shaft 32 of the swivel screw 26, the arm 44 is tightly clamped against the saddle 18 for securely retaining the mouthpipe 12 in assembled relationship tightly securing the slotted arm 44 to the saddle 18.

The mouthpipe 12 can be removed from the french horn 11, by unscrewing the knob 56 from the shaft 32 and disengaging the bent portions 52 and 54 from the side walls 22 and 24 of the saddle member 18. The swivel screw 26 is then pushed down as shown in FIG. 5 and the slotted arm 44 attached to the mouthpipe 12 is pulled away from the french horn 11. The reduced portion 14 is then pulled from the receiving aperture 16 of the french horn 11.

While a particular embodiment of the invention has been shown, it should be understood, of course, that the invention is not limited thereto since many modifications may be made. It is, therefore, contemplated to cover the present invention and any such modifications as follows in the true spirit and scope of the appended claims.

The invention is claimed as follows:

1. A detachable mouthpipe assembly for releasably attaching a mouthpipe to a musical instrument comprising a mouthpipe having a reduced end portion, a receiving aperture for releasably receiving said reduced end portion, said detachable mouthpipe assembly comprising a substantially U-shaped saddle member connected to a predetermined portion of said musical instrument and a swivel screw having a head portion and a shaft, said head portion being pivotally attached to said saddle member, and a slotted arm member attached to a predetermined portion of said mouthpipe and engagable with said swivel screw and said saddle member when said reduced end portion is releasably secured to said receiving aperture of said musical instrument, and a knob releasably engaging said shaft of said swivel screw and slotted arm member for securing said mouthpipe to said musical instrument.

2. A detachable mouthpipe assembly of claim 1, wherein said saddle member includes a pair of substantially parallel side walls joined at their common ends by a concave base member, said head member of said swivel screw being pivotally secured between said first and second side walls of said saddle member and movable between a first and second position.

3. A detachable mouthpipe assembly of claim 2, wherein said slotted arm includes a curved portion attached to a portion of said mouthpipe and first and second arms extending from opposite sides of one end of said curved portion, said first and second arms being spaced from one another, and said shaft of said swivel screw extending between said first and second arm members when said shaft is in said first position.

4. A detachable mouthpipe assembly of claim 3, wherein an outer circumference of said knob is greater than the distance between said first arm and second arm of said slotted arm member.

5. A detachable mouthpipe assembly of claim 3, wherein each of said arms includes a bent member extending laterally from each end of said first and second arms, said bent members being engagable with said side walls of said saddle member.

6. A clamping device of claim 1 wherein said head of said swivel screw includes first and second side walls joined at their common opposite ends to first and second end walls and having a top wall and a bottom wall, the length of said second side wall and top wall being substantially less than the length of said first side wall and bottom wall, respectively.

7. A detachable mouthpipe assembly for releasably attaching a mouthpipe having a reduced end portion to a musical instrument having a receiving aperture for releasably receiving said reduced end portion of said mouthpipe, said detachable mouthpipe assembly comprising a saddle member having first and second laterally spaced side walls joined at their common ends by a base portion, said base portion being attachable to said musical instrument, and a swivel screw having a head and a shaft, said head of said swivel screw being pivotally secured between said side walls of said saddle by a pivot pin, and a slotted arm having a curved end attachable to said mouthpipe and first and second laterally spaced arms extending from said curved end, said shaft extending through said first and second arms, and a knob releasably engagable with said shaft for securing said slotted arm to said saddle and swivel screw.

8. A detachable mouthpipe assembly of claim 7, wherein each of said first and second arms includes a bent member extending substantially laterally from each end thereof, said bent members being engagable with said side walls of said saddle member.

9. A detachable mouthpipe assembly of claim 7, wherein an outer circumference of said knob is greater than the distance between said first and second arms of said slotted arm member.

* * * * *